US006553201B1

(12) United States Patent
Slattery et al.

(10) Patent No.: US 6,553,201 B1
(45) Date of Patent: Apr. 22, 2003

(54) REPLENISHER MECHANISM INTERFACE

(75) Inventors: Scott Thomas Slattery, Brockport, NY (US); Jerry Eugene Livadas, Webster, NY (US); James R. Carey, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/574,055

(22) Filed: May 18, 2000

(51) Int. Cl.[7] ..... G03G 15/08; G03G 15/00

(52) U.S. Cl. ..... 399/258; 222/DIG. 1; 141/363; 399/262

(58) Field of Search ..... 399/258, 262; 222/DIG. 1; 141/363, 364

(56) References Cited

U.S. PATENT DOCUMENTS 4,060,105 A * 11/1977 Feldeisen et al. ..... 141/363
5,074,342 A * 12/1991 Kraehn ..... 399/258
5,472,026 A * 12/1995 Herbst et al. ..... 399/262

* cited by examiner

*Primary Examiner*—Joan Pendegrass
(74) *Attorney, Agent, or Firm*—Lawrence P. Kessler

(57) ABSTRACT

An interface member providing flow communication of particulate material between a particulate material receptacle and a housing of a mechanism for replenishing particulate material from a receptacle to a remote reservoir. The interface member includes a casting defining a flow communication passage. A plate is attached to the casting at an angle to the horizontal to define an angled entrance to the casting. A member, associated with said angled entrance plate, is provided for guiding and holding the marking particle receptacle at a corresponding angle to the horizontal when the receptacle is installed on the angled entrance plate, whereby the angled orientation of the receptacle lets air percolate into the receptacle while the receptacle is emptying, allowing the particulate material to flow freely out of the receptacle.

11 Claims, 2 Drawing Sheets

REPLENISHER MECHANISM INTERFACE

CROSS REFERENCE TO RELATED APPLICATIONS

Reference is made to the commonly assigned U.S. Patent Application, the respective disclosures of which being incorporated herein by reference:

U.S. patent application Ser. No. 09/574,036, filed on May 18, 2000, and entitled "REPLENISHER MECHANISM FOR A DEVELOPMENT STATION OF A REPRODUCTION APPARATUS", now U.S. Pat. No. 6,298,207, issued on Oct. 2, 2001.

FIELD OF THE INVENTION

This invention relates in general to an interface mechanism for a reproduction apparatus development station, and more particularly to a reproduction apparatus development station interface mechanism which allows the marking particles receptacle to be installed at an angle from horizontal, and insures that marking particles do not leak when the receptacle is being emptied.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

The marking particles for developing the electrostatic latent image are typically supplied to the reproduction apparatus development station in a receptacle removably connected to a receiving apparatus for the development station. For example, U.S. Pat. No. 4,972,887 (issued Nov. 27, 1990, in the names of Hacknauer et al), shows a marking particle receptacle having a particle-containing portion with a base. The base has an opening facing downward in use and a flange extending outward from the opening. A cover is slidably secured to the flange.

A receiving apparatus for the receptacle includes a replenisher sump for receiving marking particles through the base of the receptacle when the opening of the receptacle is positioned directly above the sump. The receptacle with the slide cover is positioned beside the replenisher sump, and the receptacle particle-containing portion is slid off the cover and over the replenisher sump, with the flange sliding on a receiving surface that surrounds an opening for the replenisher sump. The marking particles, in a substantially fluidized state, will the flow into the replenisher sump. However, it has been found that with the receptacle in a substantially vertical orientation, the particle flow is susceptible to vapor lock which prevents complete emptying of the receptacle.

SUMMARY OF THE INVENTION

In view of the above, this invention is directed to an interface member providing flow communication of particulate material between a particulate material receptacle and a housing of a mechanism for replenishing particulate material from a receptacle to a remote reservoir. The interface member includes a casting defining a flow communication passage. A plate is attached to the casting at an angle to the horizontal to define an angled entrance to the casting. A member associated with the angled entrance plate is provided for guiding and holding the marking particle receptacle at a corresponding angle to the horizontal when the receptacle is installed on the angled entrance plate, whereby the angled orientation of the receptacle lets air percolate into the receptacle while the receptacle is emptying, allowing the particulate material to flow freely out of the receptacle.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
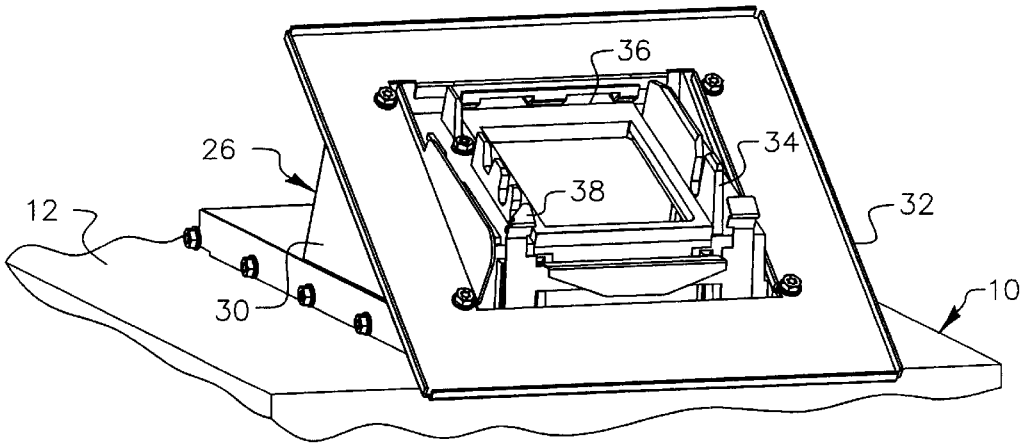
FIG. 1 is a view, in perspective, of the replenisher mechanism interface according to this invention.
Figure 3:
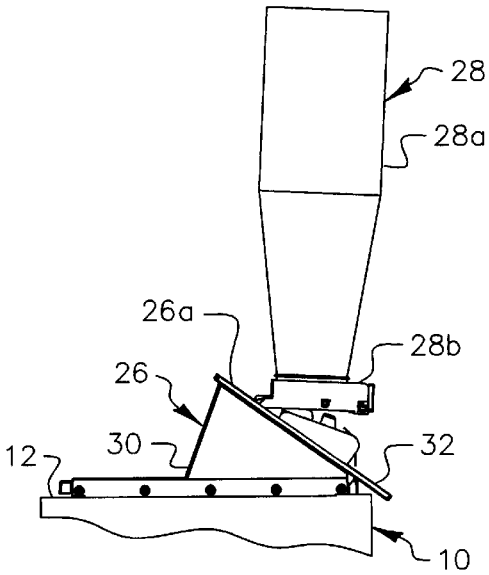
FIG. 3 is a side elevational view of the replenisher mechanism interface according to this invention, with a marking particle receptacle being inserted in operative relation thereto.
Figure 4:
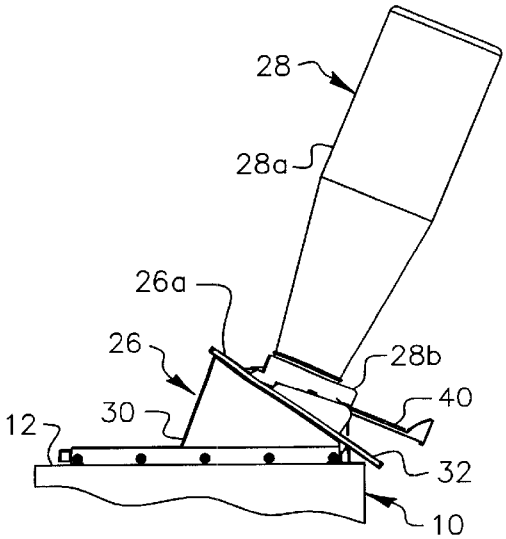
FIG. 4 is a side elevational view of the replenisher mechanism interface according to this invention, with a marking particle receptacle locked in operative relation thereto.

Referring now to the accompanying drawings, FIGS. 1, 3, and 4 show a portion of the housing 12 of a replenisher mechanism 10, such as fully described in the copending U.S. patent application Ser. No. 09/574,036, filed on May 18, 2000, now U.S. Pat. No. 6,298,207, issued on Oct. 2, 2001. The replenisher mechanism is associated for example with a reproduction apparatus to provide for refilling the development stations of the reproduction apparatus with marking particle material to develop the reproductions made by such apparatus. Mounted on the top of the housing 12 of the replenisher mechanism 10 is an interface member, according to this invention, designated generally by the numeral 26. The interface member 26 provides for connection to a particulate material (marking particle) receptacle 28 to enable selective flow communication for the marking particles between the receptacle and the housing 12 of the replenisher mechanism.

The marking particle receptacle interface member 26 is located so as to be accessible from outside of the covers of the reproduction apparatus with which the interface member is associated. Thus, marking particles may be added from the receptacle to the replenisher mechanism during a reproduction run. Moreover, the interface member 26 has an angled entrance 26*a* (see FIGS. 3 and 4) adapted to be associated with the marking particle receptacle 28 to allow the marking particles to flow out of the receptacle reliably. The marking particle receptacle interface entrance 26*a* is angled at approximately 20° from the horizontal. Without this angled mounting for the receptacle 28, marking particles would most likely flow out of the receptacle very slowly and may form a bridge or be subject to vapor lock, thereby stopping particle flow all together. The angled orientation of the marking particle receptacle 28 lets air percolate into the marking particle receptacle while the receptacle is emptying, allowing the marking particles to flow freely out of the receptacle.

The marking particles receptacle interface member 26 includes a casting 30. The casting 30 defines a passage for flow communication of marking particles emptied from the receptacle into the replenisher mechanism housing 12. A plate 32 is attached to the casting 30 at an angle to the horizontal to define the angled entrance 26*a*. The plate 32 has a member 34 for guiding and holding the marking particle receptacle 28 when it is being installed on the angled entrance 26*a*. Such arrangement allows the marking particle receptacle 28 to be installed on the interface member 26 and lie at a corresponding angle relative to the replenisher mechanism 10. A seal 36 (see FIG. 1) is provided on the member 34. A latch 38, for example of the flexible tab type, is secured to the member 34. The latch 38 serves to lock the marking particle receptacle 28 into position on the plate 32, in operative association with the seal 36, to insure that marking particles do not leak when the particulate material from the receptacle 28 is being emptied into the housing 12 of the replenisher mechanism.

Figure 5:
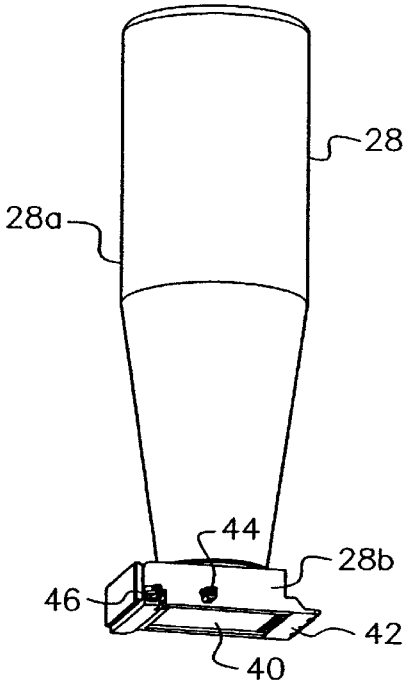
FIG. 5 is a view, in perspective, of the marking particle receptacle and slide member for association with the replenisher mechanism interface of FIG. 1.

The marking particle receptacle 28 includes substantially clear plastic bottle 28*a* with a cap 28*b* attached thereto. The cap 28*b* has a sliding mechanism 40, forming a seal, that is used to open the receptacle for emptying. Further, the cap 28*b* includes guiding features 42, 44, and locking features 46 (see FIGS. 2 and 5). The receptacle 28 is thus readily installed on the interface member 26. First the receptacle 28 is vigorously shaken to aerate the marking particles within the receptacle into a semi-liquid state. Then, the guiding features 42 of the marking particle receptacle cap 28*b* are guided into reciprocal features on the member 34 (see FIG. 3), and the receptacle is rotated (in a clockwise direction with reference to FIG. 3). As the receptacle, is so rotated, the guide feature 44 are guided into reciprocal features on the member 34, and finally the locking features 46 comes into operative association with the latch 38. When the locking features 46 are engaged with the latch 38, an audible sound (a "click" for example) is heard. The marking particle receptacle 28 will then be locked in position on the interface member 26, and the seal 36 will be compressed to create a seal between the receptacle and the interface member.

Figure 2:
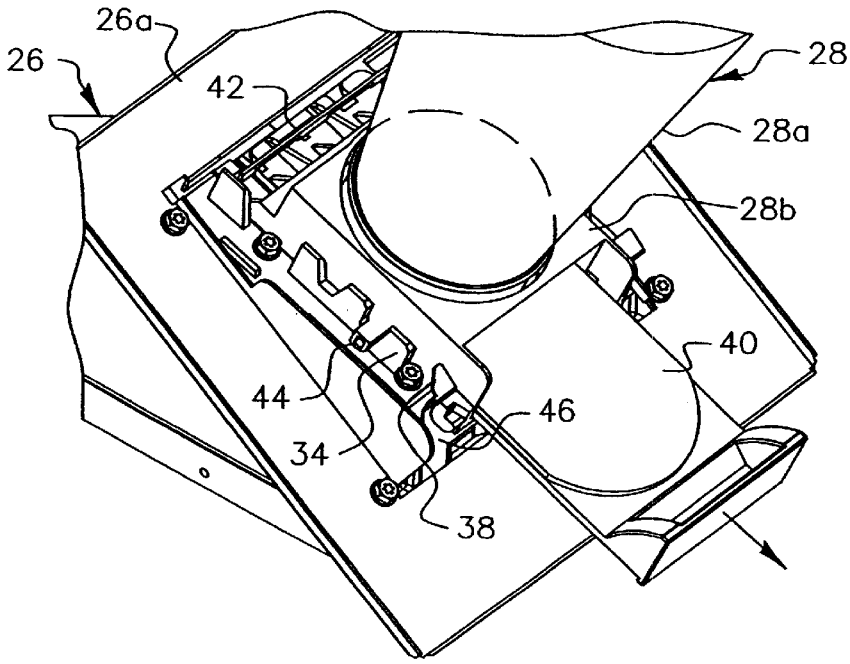
FIG. 2 is a view, in perspective and on an enlarged scale, of the replenisher mechanism interface as shown in FIG. 1, with a marking particle receptacle in place therewith.

The receptacle 28 is opened by pulling the sliding mechanism 40 in the direction indicated in FIG. 2. This opens the marking particle receptacle for emptying marking particles into the replenisher mechanism housing 12. The marking particle receptacle 28 is simply removed by pushing the sliding mechanism 40 on the receptacle cap 28*b* back to the original position, and releasing the latch 38 from the locking features 46.

It should be reemphasized that the marking particle receptacle 28 is tilted at an angle to horizontal when operatively mounted on the interface member 26. Since the marking particles in the receptacle 28 are aerated in preparation for emptying, the particulate material is essentially a liquid. As such, vapor lock can occur within the receptacle when it is opened. However, since the receptacle is tipped at an angle, it will allow air to more easily percolate up through the marking particles and into the upper part of the receptacle during emptying. This equalizes the pressure between the inside the receptacle and the inside of the replenisher mechanism housing 12. The marking particles therefore empty quickly into the housing.

The invention has been described in detail with particular reference to certain preferred embodiment thereof, but it will be understood that variations and modifications can be effected within the spirit and scope of the invention.

What is claimed is:

1. In association with a mechanism for replenishing particulate material from a receptacle to a remote reservoir, said replenisher mechanism having a housing for receipt of particulate material within said housing, an interface member providing flow communication of particulate material between a particulate material receptacle and said housing, said interface member comprising:

a casting defining a flow communication passage;

a plate attached to said casting at an angle to the horizontal to define an angled entrance to said casting; and a member, associated with said angled entrance plate, for guiding and holding the receptacle at a corresponding angle to the horizontal when the receptacle is installed on the angled entrance plate, whereby the angled orientation of the receptacle lets air percolate into the receptacle while the receptacle is emptying, allowing the marking particles to flow freely out of the receptacle.

2. The interface member according to claim 1 wherein said angled entrance plate is oriented at an angle of approximately 20° from the horizontal.

3. The interface member according to claim 1 wherein said member includes a latch to lock the receptacle into position on said angled entrance plate.

4. The interface member according to claim 3 wherein said member includes a latch and a seal, said latch serving to lock the receptacle into position on said angled entrance plate, in operative association with said seal, to insure that particulate material does not leak when the particulate material from the receptacle is being emptied.

5. The interface member according to claim 4 wherein said latch is of the flexible tab type.

6. In association with a mechanism for replenishing marking particles from a receptacle to a remote reservoir of a development station of a reproduction apparatus, said replenisher mechanism having a housing for receipt of marking particles within said housing, and said receptacle having a cap with a sliding mechanism forming a seal that is used to open the receptacle for emptying, a plurality of guiding features, and locking features, an interface member providing flow communication of marking particles between such marking particle receptacle and said housing, said interface member comprising:

a casting defining a flow communication passage for marking particles;

a plate attached to said casting at an angle to the horizontal to define an angled entrance to said casting; and a member, associated with said angled entrance plate, having features cooperating with said guiding features and locking features of said receptacle cap for guiding and holding the marking particle receptacle at a corresponding angle to the horizontal when the receptacle is installed on the angled entrance plate, whereby the angled orientation of the marking particle receptacle lets air percolate into the marking particle receptacle while the receptacle is emptying, allowing the marking particles to flow freely out of the receptacle.

7. The interface member according to claim 6 wherein said angled entrance plate is oriented at an angle of approximately 20° from the horizontal.

8. The interface member according to claim 7 wherein said member includes a latch to lock the receptacle into position on said angled entrance plate.

9. The interface member according to claim 6 wherein said member includes a latch, and a seal, said latch serving to lock the marking particle receptacle into position on said angled entrance plate, in operative association with said seal, to insure that particulate material does not leak when the particulate material from the receptacle is being emptied.

10. The interface member according to claim 9 wherein said latch is of the flexible tab type.

11. The interface member according to claim 9 wherein said receptacle interface member is located so as to be accessible from outside of the covers of the reproduction apparatus with which the interface member is associated.

* * * * *